US010987545B2

(12) United States Patent
Harkins

(10) Patent No.: US 10,987,545 B2
(45) Date of Patent: Apr. 27, 2021

(54) GRADUATED-BUOYANCY SWIMMING FLOAT APPARATUS

(71) Applicant: TURTLE PACK LTD, West Lothian (GB)

(72) Inventor: Michael Harkins, West Lothian (GB)

(73) Assignee: TURTLE PACK LTD

( * ) Notice: Subject to any disclaimer, the term of this patent is extended or adjusted under 35 U.S.C. 154(b) by 0 days.

(21) Appl. No.: 16/463,008

(22) PCT Filed: Nov. 23, 2017

(86) PCT No.: PCT/GB2017/053523
§ 371 (c)(1),
(2) Date: May 22, 2019

(87) PCT Pub. No.: WO2018/096336
PCT Pub. Date: May 31, 2018

(65) Prior Publication Data

US 2019/0282858 A1 Sep. 19, 2019

(30) Foreign Application Priority Data

Nov. 24, 2016 (GB) ..... 1619851

(51) Int. Cl.
*A63B 31/00* (2006.01)
*B63C 9/115* (2006.01)

(52) U.S. Cl.
CPC ..... *A63B 31/00* (2013.01); *B63C 9/115* (2013.01); *A63B 2208/12* (2013.01); *A63B 2209/10* (2013.01)

(58) Field of Classification Search
CPC . A63B 31/00; A63B 2209/10; A63B 2208/12; B63C 9/115
See application file for complete search history.

(56) References Cited

U.S. PATENT DOCUMENTS

| | | | | |
|---|---|---|---|---|
| 3,416,172 | A | 12/1968 | Gerling | |
| 3,425,072 | A | 2/1969 | Carlson | |
| 3,803,652 | A * | 4/1974 | Uyehara | B63B 32/00 441/66 |
| 4,538,998 | A * | 9/1985 | Holzel | B63C 9/135 441/122 |
| 5,106,331 | A * | 4/1992 | Lizarazu | B63B 32/50 441/55 |
| 5,342,232 | A | 8/1994 | Bardot | |
| 2005/0278958 | A1 * | 12/2005 | Schmidt | A47G 21/06 30/324 |
| 2009/0199784 | A1 * | 8/2009 | Oblack | A01K 15/025 119/707 |

FOREIGN PATENT DOCUMENTS

| | | | |
|---|---|---|---|
| CN | 2104043 | U | 5/1992 |
| GB | 2003431 | A | 3/1979 |
| JP | H06052854 | U | 7/1994 |
| KR | 20070105814 | A | 10/2007 |
| KR | 20080015602 | A | 2/2008 |
| WO | 9614240 | A1 | 5/1996 |

OTHER PUBLICATIONS

International Search Report & Written Opinion for PCT/GB2017/053523; dated Feb. 16, 2018; 12 pgs.

* cited by examiner

*Primary Examiner* — Stephen P Avila

(74) *Attorney, Agent, or Firm* — Gardner Groff & Greenwald, PC

(57) ABSTRACT

A wearable graduated-buoyancy swimming float apparatus for use by people learning to swim.

19 Claims, 4 Drawing Sheets

GRADUATED-BUOYANCY SWIMMING FLOAT APPARATUS

The present invention relates to a wearable graduated-buoyancy swimming float apparatus for use by people learning to swim.

BACKGROUND ART

At present, 40% of children in the UK cannot swim, while drowning is the third highest occurrence of accidental death in the UK. Not only is swimming a critical safety skill, it is a sport and an activity which has general health benefits. It is therefore important to help children learn to swim and to give parents and swimming instructors the tools to teach children to swim effectively.

A swimming float may be used by people learning to swim, or during exercise for therapeutic or training purposes, to aid them with buoyancy.

Graduated-buoyancy swimming floats are used to help children learn to swim by providing progressively adjustable buoyancy. This is done by manual adjustment of the number of floats in a harness worn on the torso of the child. Graduated-buoyancy swimming floats are not intended to protect from drowning and require constant and competent supervision.

Known graduated-buoyancy swimming floats have a number of flat flotation pads. The buoyancy can be changed by adding or removing flotation pads.

As the child progresses in their skill and confidence, the number of floatation pads is reduced to provide progressively less buoyancy. When the child has learned to swim independently, then the harness and floatation pads are removed altogether.

A known graduated-buoyancy swimming float includes removable flotation pads kept together by enclosing them in a fabric pocket, which is attached to the swimmer by straps or cords. In order to reduce the buoyancy as the swimmer's skills progress, flotation pads are removed from the pocket.

A problem with the use of a pocket is that the flotation pads have to be removed through the mouth of the pocket. This constrains the design of the pads to be thin and flat, for easy removal through the pocket.

A problem with thin and flat flotation pads is that they are flimsy and thus are easily damaged, when being removed from or inserted into the pocket, and when being stored outside the pocket.

A problem with thin flotation pads, which have larger dimensions that are constrained to be smaller than a child's back, is that they can only have a small volume. The reduction in buoyancy when removing one floatation pad is not great enough to make a sufficient difference to the overall buoyancy. Therefore, removing two or more floatation pads is necessary to achieve the desired progressive adjustment. This adds extra steps to the process of adjusting, making the process more difficult and time consuming. Furthermore, having several thin flotation pads loose outside the pocket requires extra organisation because there are more pieces.

Another problem arises from the use of a pocket because the mouth of the pocket has to be kept closed, to keep the flotation pads from becoming detached from the stabilizer. This adds steps of opening and closing the pocket mouth to the process of removing flotation pads, making the process more difficult and time consuming.

In summary, several steps are needed to adjust the buoyancy, as follows.

Ask swimmer to climb out of the pool
Open pocket
Remove floatation pad
Remove another floatation pad
Close pocket
Ask swimmer to enter the pool Another known graduated-buoyancy swimming float has four "slices", which are flat floatation pads. Slices are removed as the swimmer gets stronger. The floatation pads are made of closed-cell EVA foam. The floatation pads are attached to the child's back with a nylon strap. The strap is fed through holes or slots in each of the floatation pads. Thus, the strap is used both to keep all the floatation pads together as well as being a harness to keep the floatation pads attached to the child.

A problem with this arrangement is that it is difficult and time consuming to feed the straps out of the floatation pads in order to remove a floatation pad, then the straps have to be fed back again through some of the same holes or slots.

Another problem is that the straps have to be re-adjusted to fit the child after a floatation pad is removed, because the straps have to go around fewer floatation pads, and therefore need tightening. Straps are difficult to re-adjust and it takes some time to work out how to adjust them properly. Repeated adjustment of the fitting of the straps introduces more opportunities for error and increases the risk of improper fitting.

In summary, several steps are needed to adjust the buoyancy, as follows.

Ask swimmer to climb out of the pool
Detach harness and flotation pads from the swimmer
Feed nylon strap through floatation pads and remove a floatation pad
Adjust the back floatation pad so all floatation pads are aligned
Feed nylon strap back through remaining floatation pads
Place device on swimmer and attach
Re-adjust strap as one floatation pad has been removed
Ask swimmer to enter the pool
This is a time consuming and complex process.

SUMMARY OF INVENTION

It is desirable to provide a graduated-buoyancy swimming float apparatus that overcomes at least some of the above-mentioned problems.

According to an aspect of the present invention, there is provided a wearable graduated-buoyancy swimming float apparatus comprising a plurality of floats wherein at least some of the floats are configured to be nestable together. Preferably, the floats are configured to be nestable together by snap-fitting together.

Preferably, a protrusion integral with a float is configured to engage with a corresponding indent on another float to provide the snap-fit.

Preferably, a plurality of the protrusions integral with a float are distributed around a rim of the float, to provide an annular snap-fit joint. Any one of the floats may comprise a plurality of protrusions, for example, two, three, four, five, six, seven or eight protrusions. In certain embodiments, a second float (which be nested or sandwiched between a first (inner) float and third (outer) float) has four protrusions distributed about its rim which engage with a corresponding number of indents in the first float. In such embodiments, a third float may have two protrusions, positioned, for example, at opposing rim positions, which engage with a corresponding number of indents on the first float.

Preferably, the apparatus further comprises at least one strap and at least some of the floats are configured to be threadable by the at least one strap to hold the floats together.

Preferably, the floats have corresponding concave and convex surfaces such that the floats are nestable by the convex surface of a float fitting into the concave surface of another of the floats.

Preferably, the floats have a rounded turtle shell shape.

Preferably, the floats comprise closed-cell ethylene-vinyl acetate (EVA) foam.

Preferably, the apparatus further comprises a harness. Preferably, the harness comprises a vest.

Preferably, a first float is affixed to the harness, and a second float is snap-fit interlockable with the first float.

Preferably, a third float is snap-fit interlockable with the first float.

Preferably, the first float is provided with a set of indents configured to engage with corresponding protrusions on the second float and another set of indents configured to engage with corresponding protrusions on the third float.

Preferably, the third float is configured to sandwich the second float between itself and the first float when snap-fit interlocked with the first float.

BRIEF DESCRIPTION OF DRAWINGS

Embodiments of the present invention will now be described, by way of example only, with reference to the drawings, in which.

DESCRIPTION OF EMBODIMENTS

The inventors have devised a wearable graduated-buoyancy swimming float apparatus in which the adjustment of buoyancy is very fast and simple to achieve making it user-friendly, while the floats are held in place safely and securely. Wearable is defined as attachable to the swimmer's body without the swimmer needing to hold on to it, such that the swimmer's arms are free to use for swimming.

Figure 1:
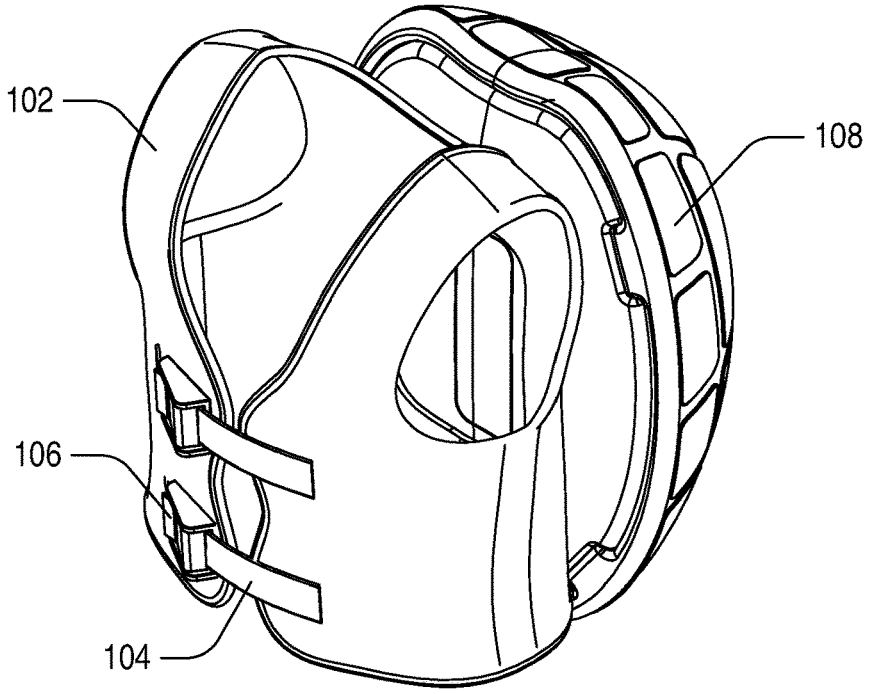
FIG. 1 illustrates a front view of a fully-assembled wearable graduated-buoyancy swimming float apparatus according to an embodiment of the present invention.
Figure 2:
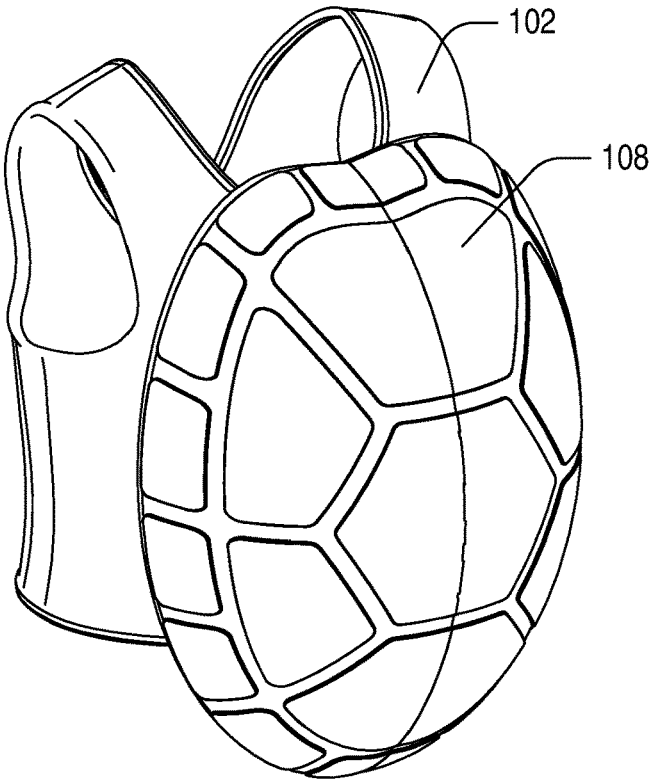
FIG. 2 illustrates a rear view of the fully-assembled wearable graduated-buoyancy swimming float apparatus.

FIGS. 1 and 2 illustrate front and rear views of a fully-assembled wearable graduated-buoyancy swimming float apparatus according to an embodiment of the present invention. With reference to FIGS. 1 and 2, a harness, in this example a vest, 102 is made from 3 mm nylon-lined neoprene, with an edging strip. Webbing straps 104 with ABS plastic clamp buckles 106 are used to adjust fit on the child. A larger vest could be used to fit a large child or adult, with the size of the floats increased accordingly.

The vest 102 is attached to floats 108 via two webbing straps that are fed through an insert, which is described with reference to FIGS. 3 and 4 below. The floats 108 may be made from Ethylene-vinyl acetate (EVA) foam or another material suitable for water products and that is durable. The harness in this example is a vest made of neoprene as this provides comfort and a tight secure fit for the child.

In all the figures, features in common with preceding figures share the same reference numerals.

Figure 3:
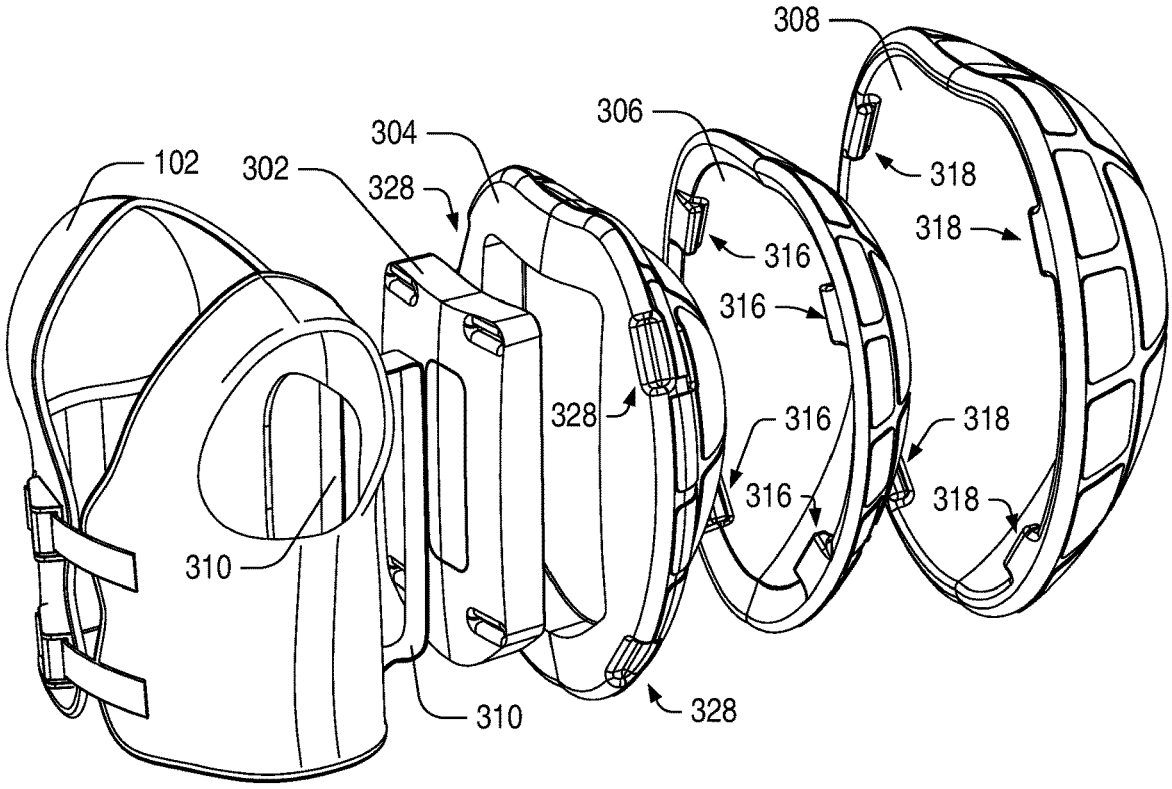
FIG. 3 illustrates an exploded front view of the wearable graduated-buoyancy swimming float apparatus.
Figure 4:
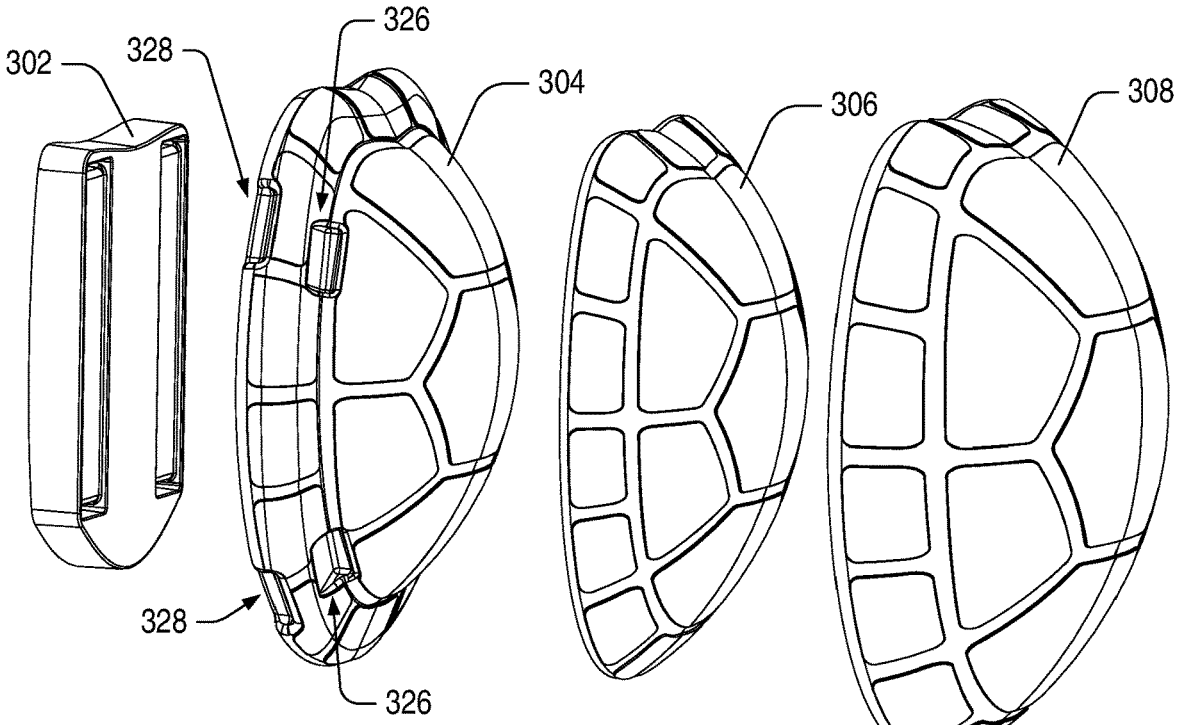
FIG. 4 illustrates an exploded rear view of the wearable graduated-buoyancy swimming float apparatus.

FIGS. 3 and 4 illustrate exploded front and rear views of the graduated-buoyancy swimming float apparatus. Nestable floats 304, 306, 308 are made from injection moulded closed-cell (waterproof) EVA foam, having a density of approximately 50 kg/m3. Ethylene-vinyl acetate (EVA), also known as poly(ethylene-vinyl acetate) (PEVA), is the copolymer of ethylene and vinyl acetate. The weight percent vinyl acetate usually varies from 10 to 40%, with the remainder being ethylene.

The first float 304 has an insert 302. Two straps 310 on the rear of the vest 102 are fed through insert 302 before the insert 302 is bonded into the first float 304. In this way the first float 304 is connected to the vest 110.

The floats 304, 306, 308 are configured to be nestable together by snap-fitting together. The snap-fit joint is a frictional, form-fitting joint. The structural features of the snap-fit joint may be protrusions that may include hooks, knobs, or bulges on one of the floats to be joined, which engage with corresponding indents, which may include recesses, depressions, undercuts, detents, or openings in the other float to be joined.

In this example, protrusions 316 integral with the second float 306 are configured to engage with corresponding indents 326 (shown in FIG. 4, but not visible in FIG. 3) on the first float 304 to provide a snap-fit joint. Similarly, protrusions 318 integral with the third float 308 are configured to engage with corresponding indents 328 on the first float 304 to provide a snap-fit joint. The protrusions 316 and 318 are distributed around the rim of the respective floats 306 and 308. The resulting annular snap-fit joint benefits from the double curvature of the rounded turtle shell shape, pulling the protrusions into the centre to keep a secure grip on the inner nested float.

The first float 304 is provided with two sets of indents (recesses). Having differently spaced and positioned sets of indents in the first float 304 correctly locates the second 306 and third 308 floats so that they fit properly together in the way described with reference to FIGS. 5 to 8.

The snap-fit can be engaged by pushing an outer float onto an inner float. The rounded turtle shell shape advantageously helps guide the nested fitting together of the floats. The snap-fit can be disengaged by inserting fingers or thumbs under the rim of the outer float at the locations of the protrusions and levering the protrusions out of the slots enough to overcome the friction of the snap-fit joint. Additional indents may be provided adjacent to the protrusion-receiving indents, to facilitate fingers or thumbs to be inserted.

In another example (not shown), the outer float may have two protrusions, positioned, for example, at opposing rim positions, configured to engage with a corresponding number of indents on the first float. Each of the two protrusions are preferably of the same dimensions and each extend along a substantial part of each opposing rim.

The floats may be made from any suitable polymeric foam material providing buoyancy.

EVA foam structures made by injection moulding have a resilient skin, which makes the snap fit grip well, while the softer inner has the flexibility to allow easy undoing of the snap-fit joint. As an alternative to the integral protrusions and indents, hard plastic inserts may be embedded in and/or bonded to the floats to provide the protrusions and/or the lining of the indents for a hardwearing and firm snap-fit joint.

Another suitable material for the floats is polyurethane foam. It can be made tougher and harder, with more crush resistance. However, it is slow to cure, using a catalyst, so multiple tools are needed for volume production.

Polyurethane foam may be overmolded on a frame or web. The frame or web may provide the protrusions and indent or recess for the snap fit, while the foam provides the buoyancy. Because EVA injection mould cavities are smaller than (about half the size) the finished foam float, which expands after moulding, such overmolding is not suitable when using EVA foam.

Figure 5:
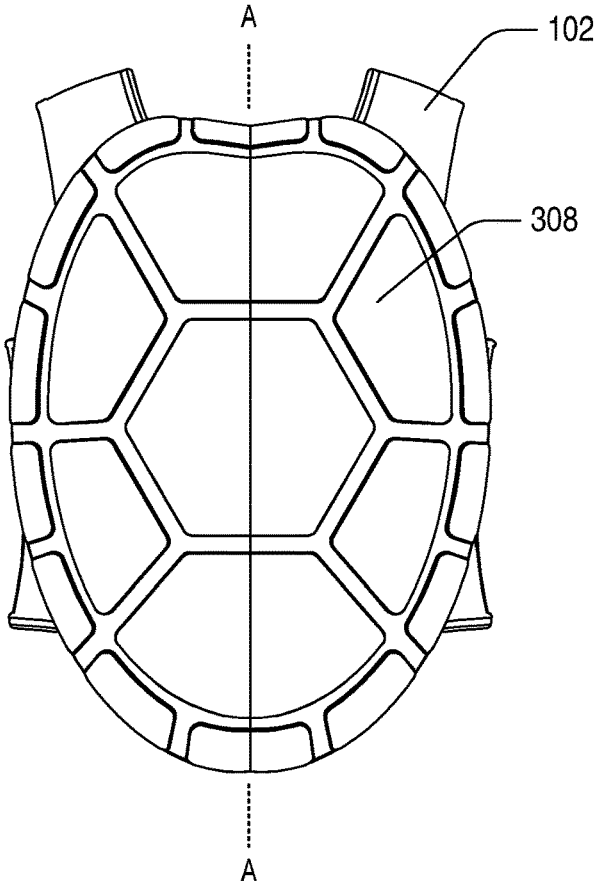
FIG. 5 illustrates a rear view of the wearable graduated-buoyancy swimming float apparatus, showing the cross-section line used for FIGS. 6 to 8.

At least some of the floats are configured to be nested, which is illustrated in FIGS. 5 to 8. Being nested means to fit fully or mostly fit the volume of one float within another one. FIG. 5 illustrates a rear view of the graduated-buoyancy swimming float apparatus, showing the cross-section line A-A used for FIGS. 6 to 8.

Figure 6:
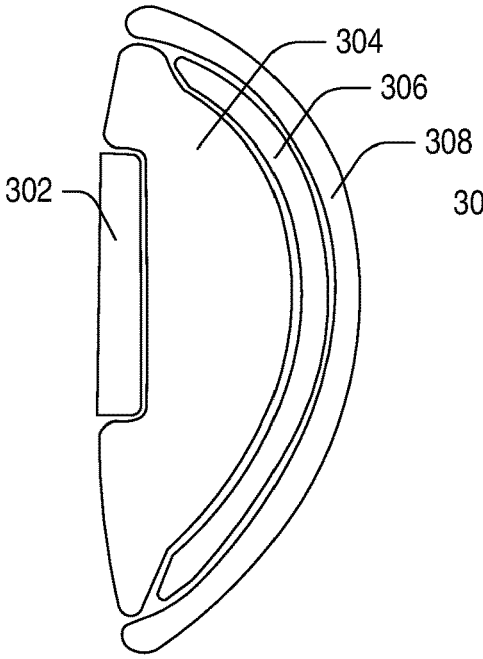
FIGS. 6 to 8 illustrate cross-sections through three configurations of the graduated-buoyancy swimming float apparatus, showing the floats nested together.
Figure 7:
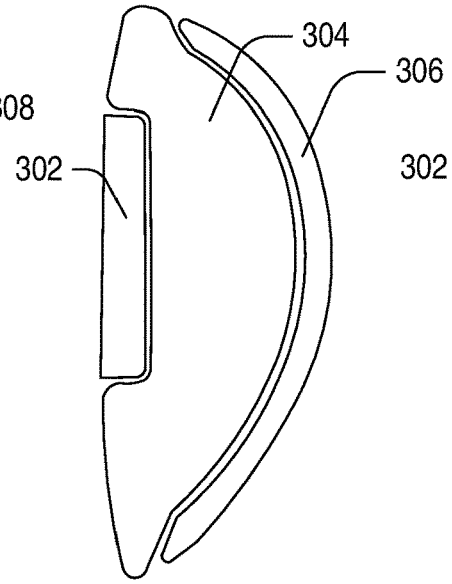
Figure 8:
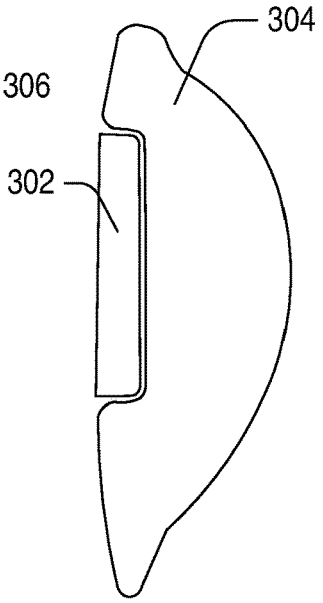

FIGS. 6 to 8 illustrate cross-sections along the line A-A through three configurations of the graduated-buoyancy swimming float apparatus, with the floats nested together.

The floats 304, 306 and 308 have a rounded shell shape and have corresponding concave and convex opposing surfaces. The floats are nestable by the convex surface of one float fitting into the concave surface of another float. A turtle rounded shell-shaped float with its concave and convex surfaces allows for strong mechanical support of the rim, compared to a flat floatation pad. The rounded turtle shell shape provides an even distribution of the annular snap-fit clamping force amongst the protrusions 316 and 318 that are distributed around the rims of the floats 306 and 308 respectively, as shown in FIG. 3. This helps to keep the floats securely attached together and to the vest. The rounded turtle shell shape is hydrodynamically efficient and passes through water with reduced drag, compared to block-shaped floats. Furthermore, the nested shells still have this efficient and attractive shape even as each outer shell is removed. At the top of the floats, a depression in the rounded shape is provided conforming to the child's neck when in use, to facilitate free movement of the child's head with less interference with the floats.

With reference to FIG. 6, all the floats are stacked onto each other. The first float 304 is affixed to the vest (not shown) via the insert 302, and the second float 306 is snap-fit interlocked with the first float 304. The third float 306 is also snap-fit interlocked with the first float.

Attaching the third float 308 to the first float 304 keeps it more securely attached to the child, compared to interlocking the third float with the second float.

The third float 308 is configured to sandwich the second float 306 between itself and the first float 304 when snap-fit interlocked with the first float 304. Thus the second float 306 is conveniently hidden away, sandwiched between the first 304 and third 308 floats and entirely nested within the third float 308. This prevents accidental dislodging of the second float 306.

In this example, the height of the third float is typically 300 mm, with a width of 210 mm and a depth of 120 mm. The first float 304 has a lip to provide increased volume and therefore buoyancy. The lip also acts as support for the second float 306.

In another example, the height of the third float is typically from about 200 mm to about 400 mm, for example, from about 250 mm to about 350 mm, with a first of from about 180 mm to about 240 mm, for example, from about 190 mm to about 230 mm, or from about 200 mm to about 220 mm, and a depth of from about 100 mm to about 140 mm, for example, from about 110 mm to about 130 mm.

It is apparent that the undercuts moulded into the foam allow these floats to snap-fit onto the first float. They can be independently added or removed to increase or decrease the overall buoyancy, depending on the swimmer's ability.

Advantageously, the strap system (neoprene vest) is only attached to the first float therefore when adjusted to fit one specific swimmer no re-adjustment is needed when the floats are removed.

Embodiments of the present invention provide a process of adjusting buoyancy that is quick and easy, having just the following steps.

Ask swimmer to climb out of the pool

Remove float

Ask swimmer to enter the pool

This has fewer steps compared to the prior art, while the nested snap-fit mechanism securely attaches the floats to the swimmer. The rigid rounded turtle-shell shape ensures a good snap-fit joint when using a float material such as EVA foam.

Figure 9:
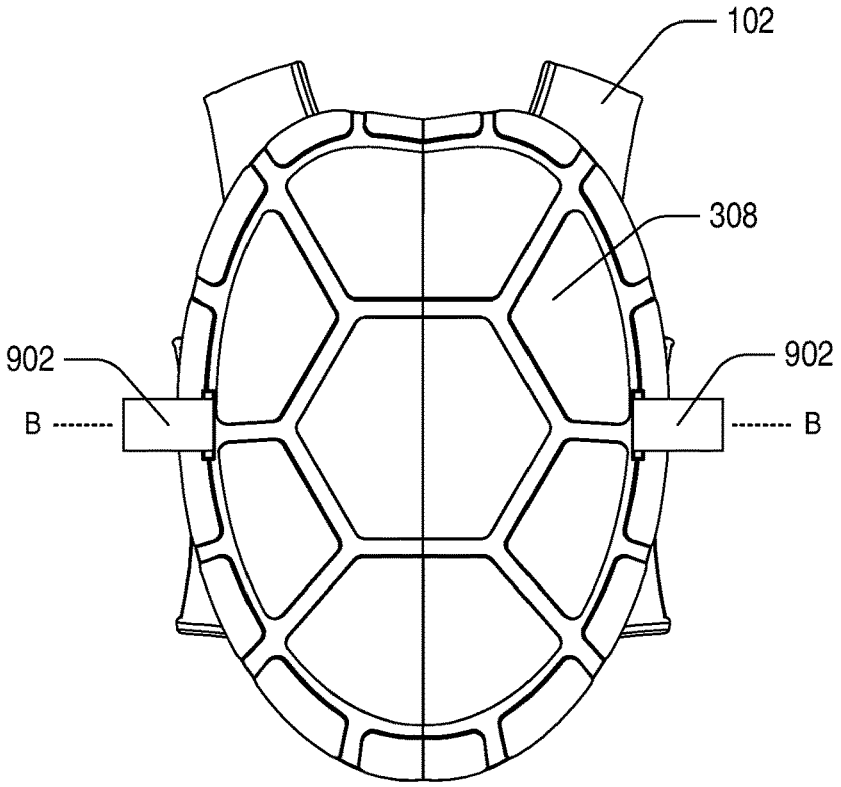
FIG. 9 illustrates a rear view of a wearable graduated-buoyancy swimming float apparatus according to another embodiment of the present invention, showing a cross-section line used for FIG. 10.
Figure 10:
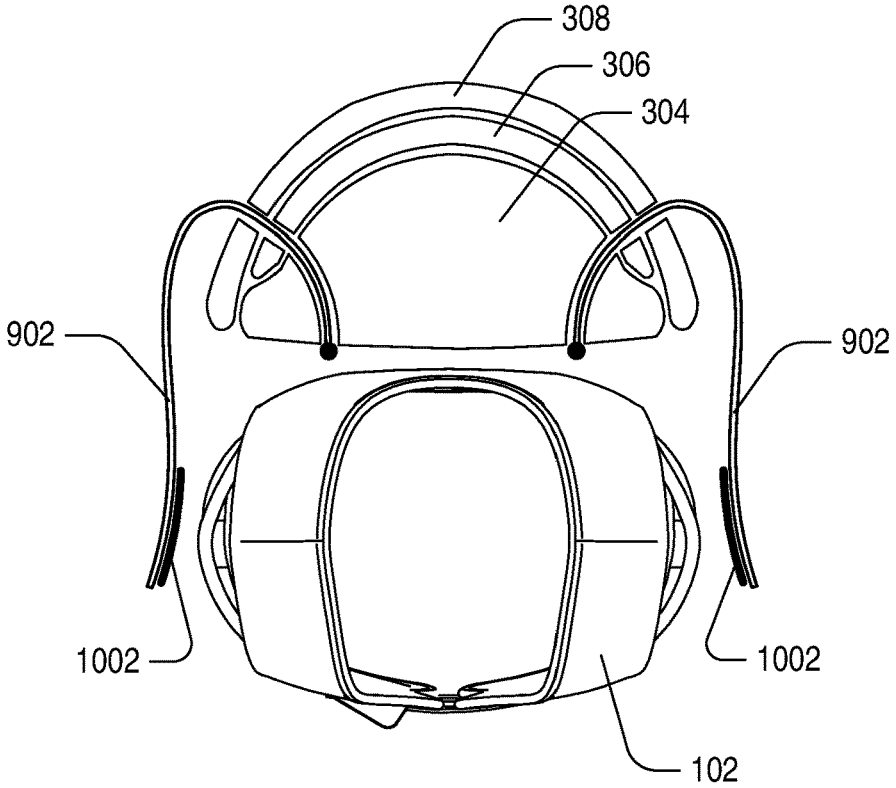
FIG. 10 illustrates a cross-section through a fully-assembled wearable graduated-buoyancy swimming float apparatus of FIG. 9, with the floats held together by straps.

FIG. 9 illustrates a rear view of the wearable graduated-buoyancy swimming float apparatus according to another embodiment of the present invention with the floats held together by straps, showing the cross-section line B-B used for FIG. 10.

FIG. 10 illustrates a cross-section along the line B-B through a fully-assembled wearable graduated-buoyancy swimming float apparatus of FIG. 9. The vest 102 is not shown as a cross section, rather a top-down view is shown. In this example there is no snap fit, however, snap fitting as described herein may be combined with the use of straps to securely hold the floats together.

With reference to FIGS. 9 and 10, webbing straps 902 are provided with a portion 1002 having hooks of a hook and loop fastener (such as Velcro™). ABS plastic clamp buckles may alternatively be used, or other manually releasable attachment means. The straps 902 are used to attach the nested floats 304, 306, 308 to the vest 102, where it has corresponding portions having loops. At least some of the floats are configured to be threadable by the straps to hold the floats together, in this example by holes in the floats large enough for the straps to be threaded through.

In order to remove floats, the hook and loop fastening of the straps is undone and the straps are unthreaded out of the float being removed. The hook and loop fastening is then re-done to attach the remaining floats to the vest. In an alternative embodiment, not shown, a strap may attach to itself with a hook and loop fastening, after being threaded through a slot, or ring, on the vest.

In another embodiment, at least some, or all, of the floats are configured to be nestable together by hook and loop fastening means (such as Velcro™). In such embodiments, hooks or loops on the convex surface of one float fasten to loops or hooks, respectively, on the concave surface of another float.

The invention claimed is:

1. A wearable graduated-buoyancy swimming float apparatus comprising a plurality of floats wherein at least some of the floats are configured to be nestable together, wherein the floats have a rounded shell shape and have corresponding concave and convex opposing surfaces such that the floats are nestable by the convex surface of a float fitting into the concave surface of another of the floats, and further comprising at least one strap and wherein at least some of the floats are configured to be threadable by the at least one strap to hold the floats together.

2. The apparatus of claim 1, wherein the floats are configured to be nestable together by snap-fitting together.

3. The apparatus of claim 2, wherein a protrusion integral with a float is configured to engage with a corresponding indent on another float to provide the snap-fit.

4. The apparatus of claim 3, wherein a plurality of the protrusions integral with a float are distributed around a rim of the float, to provide an annular snap-fit joint.

5. The apparatus of claim 1, wherein the floats have a rounded turtle shell shape.

6. A wearable graduated-buoyancy swimming float apparatus comprising a plurality of floats wherein at least some of the floats are configured to be nestable together, wherein the floats have a rounded turtle shell shape and have corresponding concave and convex opposing surfaces such that the floats are nestable by the convex surface of a float fitting into the concave surface of another of the floats.

7. The apparatus of claim 1, wherein the floats comprise closed-cell ethylene-vinyl acetate (EVA) foam.

8. A wearable graduated-buoyancy swimming float apparatus comprising a plurality of floats wherein at least some of the floats are configured to be nestable together, wherein the floats have a rounded shell shape and have corresponding concave and convex opposing surfaces such that the floats are nestable by the convex surface of a float fitting into the concave surface of another of the floats, and further comprising a harness.

9. The apparatus of claim 8, wherein the harness comprises a vest.

10. The apparatus of claim 8, wherein a first float is affixed to the harness, and a second float is snap-fit interlockable with the first float.

11. The apparatus of claim 10, wherein a third float is snap-fit interlockable with the first float.

12. The apparatus of claim 11, wherein the first float is provided with a set of indents configured to engage with corresponding protrusions on the second float and another set of indents configured to engage with corresponding protrusions on the third float.

13. The apparatus of claim 11, wherein the third float is configured to sandwich the second float between itself and the first float when snap-fit interlocked with the first float.

14. The apparatus of claim 6, wherein the floats are configured to be nestable together by snap-fitting together.

15. The apparatus of claim 14, wherein a protrusion integral with a float is configured to engage with a corresponding indent on another float to provide the snap-fit.

16. The apparatus of claim 15, wherein a plurality of the protrusions integral with a float are distributed around a rim of the float, to provide an annular snap-fit joint.

17. The apparatus of claim 6, further comprising at least one strap and wherein at least some of the floats are configured to be threadable by the at least one strap to hold the floats together.

18. The apparatus of claim 6, wherein the floats comprise closed-cell ethylene-vinyl acetate (EVA) foam.

19. The apparatus of claim 8, wherein the floats comprise closed-cell ethylene-vinyl acetate (EVA) foam.

* * * * *